United States Patent [19]

Hamada et al.

[11] 4,397,691

[45] Aug. 9, 1983

[54] METHOD FOR PRODUCING FE-B MOLTEN METAL

[75] Inventors: Takao Hamada; Nobuo Tsuchiya; Toshihiro Inatani; Yoshiyasu Takada; Mitsuo Sumito, all of Chiba; Eiji Katayama; Toshimitsu Koitabashi, both of Ichihara; Kyoji Okabe; Yo Ito, both of Chiba, all of Japan

[73] Assignee: Kawasaki Steel Corporation, Kobe, Japan

[21] Appl. No.: 401,001

[22] Filed: Jul. 22, 1982

[30] Foreign Application Priority Data

Oct. 30, 1981 [JP] Japan ..... 56-174960

[51] Int. Cl.[3] ..... C21B 5/02; C21B 13/02

[52] U.S. Cl. ..... 75/123 B; 75/133.5

[58] Field of Search ..... 75/123 B, 129, 133, 75/133.5, 11, 38

[56] References Cited

U.S. PATENT DOCUMENTS

| | | | |
|---|---|---|---|
| 1,537,997 | 5/1925 | Miyaguchi | 75/123 B |
| 2,162,402 | 6/1939 | Hornemarr | 75/133.5 |
| 2,544,697 | 3/1951 | Lewis | 75/38 |
| 2,755,181 | 7/1956 | Spire | 75/133 |
| 3,809,547 | 5/1974 | Lewis et al. | 75/11 |
| 4,124,378 | 11/1978 | Kurdowski et al. | 75/11 |

*Primary Examiner*—M. J. Andrews

*Attorney, Agent, or Firm*—Balogh, Osann, Kramer, Dvorak, Genova & Traub

[57] ABSTRACT

Fe-B molten metal for producing amorphous alloys are produced in a low cost by using a vertical furnace wherein beds packed with a carbonaceous solid reducing agent are formed and two or three stages of tuyeres are provided in the lower portion of said furnace, feeding a preliminarily reduced powdery iron ore into the furnace through the upper stage of tuyeres together with hot air and feeding boron oxide or boric acid into the furnace through the lower stage of tuyeres together with hot air and, if necessary blowing hot air into the furnace through the lowest stage of tuyeres. In stead of the above described vertical furnace, a usual blast furnace provided with one or two stages of tuyeres at the lower portion of said furnace is used. In this case, sintered iron ore, pellet-formed iron ore or lump iron ore is fed from the top of the furnace and powdery boron oxide or boric acid is fed through the tuyeres.

4 Claims, 3 Drawing Figures

METHOD FOR PRODUCING FE-B MOLTEN METAL

BACKGROUND OF THE INVENTION

1. Field of the Invention

The present invention relates to the production of Fe-B molten metal.

2. Description of the Prior Art

Amorphous alloys consisting mainly of Fe-B have excellent properties as electromagnetic materials. When amorphous alloys are used as a core material of a transformer, the iron loss of the amorphous alloy is about $\frac{1}{3}$ that of conventional grain-oriented silicon steel sheets but there is a problem in the production cost. About half of the cost for producing an amorphous ribbon is now the price of boron, so that it is important to obtain a method for producing boron-containing materials in a low cost.

Heretofore, boron itself has been produced by burning boric acid and by reducing the acid with Al or Mg metal, or by electrolyzing molten boric acid with potassium chloride, or by reducing boron chloride with hydrogen and the like, but in any methods, elementary boron is expensive, so that boron is not suitable for a starting material for Fe-B electromagnetic materials.

Ferroboron is smelted by thermit process with aluminum or an electric furnace process but the thermit process is not suitable for an amorphous material, because Al is included in ferroboron and the electric furnace process has a problem in a high price, because an amount of electric power consumed is high.

SUMMARY OF THE INVENTION

The present invention is to provide a method for producing Fe-B molten metal in a far lower cost than prior processes without using metals, such as Al and electric power.

The present invention is based on the following novel discovery for producing Fe-B molten metals and has been accomplished by improving a method for producing molten metals from powdery ores.

(1) A melting point of boron oxide is about 450°-600° C. and a melting point of boric acid is about 185° C., so that it is impossible to pre-heat or preliminarily reduce these substances by using an exhaust gas from a melting and reducing furnace (referred to as "melt-reducing furnace" hereinafter).

(2) It is better to preliminarily reduce iron oxide, so that iron oxide and boron oxide or boric acid must be separately fed.

(3) Boron oxide is hardly reduced and needs a high temperature and a strong reducing atmosphere for the reduction but boron oxide is readily vaporized at a high temperature as $B_2O_3$, $B_2O_2$, $B_2O$ and BO.

(4) In order to improve the yield of boron in reduction, it is effective to contact the vaporized boron oxide with molten iron saturated with carbon in coke-packed beds in counter-current.

(5) A ratio of an amount of boron oxide (boric acid is calculated into an amount of boron oxide) to an amount of iron oxide has the optimum range.

The present invention will be explained in more detail hereinafter.

DESCRIPTION OF THE PREFERRED EMBODIMENTS

The present invention will be explained with reference to the accompanying drawings.

Figure 1:
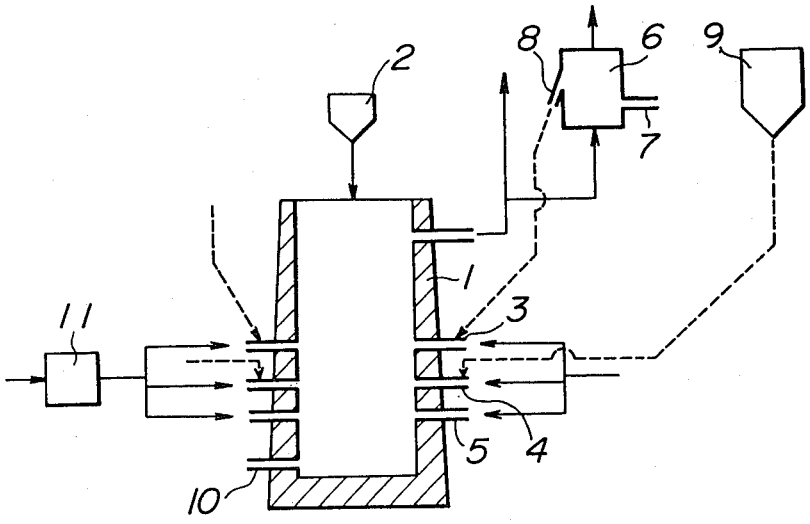
FIG. 1 is a diagrammatic view showing an apparatus for carrying out a method of Example 1 in the present invention.

FIG. 1 is a systematic view illustrating an example of the present invention. A carbonaceous solid reducing agent, preferably lump coke is charged in a vertical furnace 1 through a charging device 2 and reducing agent-packed beds are formed in the vertical furnace 1. Two or three stages of tuyeres are provided in a lower portion of the vertical furnace 1. The upper stage is tuyeres 3 for feeding a preliminarily reduced ore together with hot air, the lower stage is tuyeres 4 for feeding boron oxide or boric acid together with hot air and the lowest stage is tuyeres 5 for feeding only hot air, if necessary.

To each tuyere, is blown hot air (air or oxygen-rich air) heated at a high temperature through a hot air stove 11 and simultaneously iron oxide preliminarily reduced in a fluidized bed as preliminarily reducing furnace 6 and a boron-containing powdery substance stocked in a hopper 9 are charged from the upper stage of tuyeres 3 and from the lower stage of tuyeres 4 respectively as shown in FIG. 1.

The preliminarily reduced iron oxide is prepared by reducing iron oxide supplied to the fluidized bed as preliminarily reducing furnace 6 by using exhaust gas having a high temperature, which is generated in a vertical furnace 1. As iron oxides, use may be made of powdery iron ore, mill scale, dust, etc.

Boron-containing substances include borax ($Na_2O.B_2O_3.10H_2O$), Kernite ($Na_2O.2B_2O_3.4H_2O$) and the like as minerals, boric acid ($H_2BO_3$) obtained by treating these substances with sulfuric acid and boron oxide ($B_2O_3$) obtained by heating boric acid. As the boron-containing substances to be used in the present invention, boron oxide or boric acid is generally used, but as other substances than these substances, boron-containing dusts formed upon burning when magnesia clinker is produced from seawater and dusts collected from gas formed in the method of the present invention may be used.

When boric acid is heated, the acid is simply decomposed to form boron oxide.

$$2H_3BO_3 \rightarrow B_2O_3 + 3H_2O$$

Accordingly, the reaction in the furnace supplied with boric acid is similar to that supplied with boron oxide.

$$\left(\begin{array}{c}\text{An amount of boron oxide}\\ \text{formed from boric acid}\end{array}\right) = (\text{amount of boric acid}) \times 0.563.$$

The preliminarily reduced iron oxide is transferred from an outlet 8 of a preliminarily reducing furnace 6 to upper tuyeres 3 and boron oxide or boric acid is transferred from a hopper 9 to lower tuyeres 4 by applying the principle of gravitational transport and pneumatic transport.

In the vicinity ot the top of the upper stage of tuyeres 3, the lower stage of tuyeres 4 and if necessary, the lowest stage of tuyeres 5 in the vertical furnace 1, are formed raceways in the same manner as in the vicinity of the top of tuyeres of a blast furnace due to hot air and zones having a high temperature of 2,000°–2,500° C. are formed and the preliminarily reduced iron oxide and boron oxide which are fed into these zones together with hot air or hot air added with oxygen, are immediately heated and easily melted. And the melts are reduced during dropping down through coke-packed beds at the lower portion of the furnace 1 to form a molten metal and a molten slag and the molten metal and the slag are pooled at the hearth of the furnace and timely discharged out of the furnace from a taphole 10.

As mentioned above, a part of boron oxide is vaporized at a high temperature, so that it has been generally difficult to increase the yield of reduction but in the present invention, the preliminarily reduced iron oxide is fed into the furnace from the upper tuyeres 3 and boron oxide or boric acid is fed into the furnace from the lower tuyeres 4, so that the dropping molten iron saturated with carbon and the ascending gaseous boron oxide are contacted in counter-current and efficiently reacted and boron oxide is reduced and boron is absorbed into the molten iron. When an amount of boron oxide fed is much, a heat energy at the lower portion of the furnace is deficient and therefore the heat energy necessary for the reduction reaction may be supplemented by feeding hot air through the lowest stage of tuyeres 5.

Figure 2:
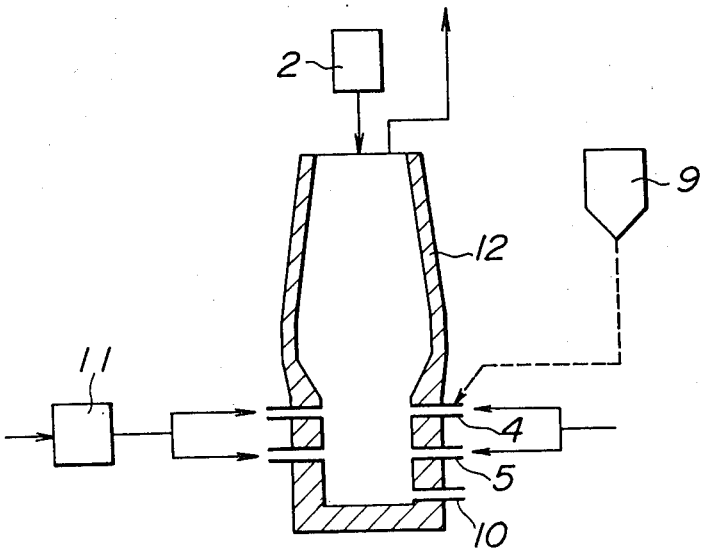
FIG. 2 is a diagrammatic view showing an apparatus for carrying out a method of Example 2 in the present invention.
Figure 3:
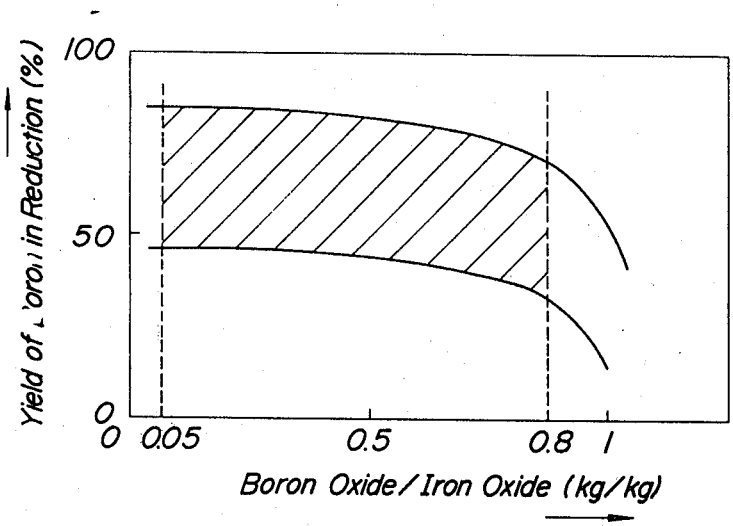
FIG. 3 is a graph showing the relation of an yield of boron in reduction to a weight ratio of boron oxide (boric acid is calculated into an amount of boron oxide) to iron oxide.

FIG. 2 is a schematic view showing an example for producing Fe-B molten metal using a same vertical furnace 12 as a blast furnace for producing usual pig iron.

In the blast furnace, as iron oxide, powdery ores are firstly transformed into sintered ores or pellets and then charged into the blast furnace 12 from a feeding device 2 at the furnace top alternately with lump coke. The lump ores are directly charged in the blast furnace in the same manner as described above. Iron oxide is heated and reduced during descending in the furnace and melted and dropped down through the coke-packed beds.

Boron oxide or boric acid is transferred from a hopper 9 to tuyeres 4 and fed into the blast furnace together with hot air fed from a hot stove 11. When a heat energy at the lower portion of the furnace is deficient, tuyeres 5 for feeding only hot air are additionally provided at the lower stage and the necessary heat energy is supplemented.

The difference of the examples in FIG. 1 and FIG. 2 lies in that the preliminarily reduced iron oxide is fed from the tuyeres or lump form of iron oxide not preliminarily reduced is fed from the furnace top.

Boron oxide or boric acid is fed from tuyeres provided at a lower position than the level where the molten iron is formed, in both the examples. In this case, it has been found that the reduction efficiency of boron is highly influenced by a ratio of boron oxide (boric acid is calculated to boron oxide amount) to iron oxide. When the weight ratio of boron oxide/iron oxide is less than 0.05, a concentration of boron in the formed molten metal is low and not suitable for production of amorphous ribbon and when said ratio exceeds 0.8, the reduction yield of boron is decreased and the refining cost increases and such a case is not economical.

The following examples are given for the purpose of illustration of this invention and are not intended as limitations thereof.

Example 1

This example was carried out following to the production system shown in FIG. 1.

| | | |
|---|---|---|
| (1) | Boron-containing substances | boron oxide |
| | Grain size | less than 200 meshes |
| | Supplied amount to the lower tuyeres | 86 kg/hr |
| (2) | Iron ore | Brazil MBR ore |
| | Grain size | less than 2 mm |
| | Supplied amount to the preliminary reducing furnace | 740 kg/hr |
| | Supplied amount to the upper stage of tuyeres | 600 kg/hr. |
| | Preliminary reduction ratio | 65% |
| (3) | Carbonaceous solid reducing agent | coke |
| | Grain size | 20–30 mm |
| | Supplied amount | 603 kg/hr |
| (4) | Amount of air blown into the vertical furnace | 1,800 $Nm^3$/hr |
| | Blown air temperature | 900° C. |
| | Number of air blowing tuyeres | |
| | Total: 12, In each of the upper, lower and lowest stages: 4, To the upper stage of four tuyeres: preliminarily reduced iron ore, To the lower stage of four tuyeres: boron oxide. | |
| (5) | Amount of Fe—B molten metal produced | 507 kg/hr (B = 3.1%, Si = 2.6%, C = 3.2%, Fe = Bal) |
| (6) | Amount of slag formed | 634 kg/hr |

Example 2

This example was carried out following to the production system shown in FIG. 2.

| | | |
|---|---|---|
| (1) | Boron-containing substance | boric acid |
| | Grain size | less than 200 meshes |
| | Supplied amount to the upper stage of tuyeres | 80 kg/hr |
| (2) | Iron ore | sintered ore |
| | Grain size | 5–10 mm |
| | Supplied amount | 560 kg/hr |
| (3) | Solid reducing agent | coke |
| | Grain size | 20–30 mm |
| | Supplied amount | 405 kg/hr |
| (4) | Amount of air blown | 1,200 $Nm^3$/hr |
| | Blown air temperature | 900° C. |
| | Number of air blowing tuyeres | |
| | In each of the upper and lower stages: 4 Total: 8 (To the upper stage of four tuyeres: boric acid) | |
| (5) | Amount of Fe—B molten metal produced | 304 kg/hr (B = 3.3%, Si = 2.9%, C = 3.0%, Fe = Bal) |
| (6) | Amount of slag formed | 420 kg/hr |

As explained above in detail, Fe-B molten metal can be smelted without using a high cost of electric power or metals such as Al according to the present invention, so that the cost for producing Fe-B amorphous thin strips can be considered reduced.

What is claimed is:

1. A method for producing ferro-boron which comprises introducing a reducing gas into a fluidizing furnace, the reducing gas being exhausted from a vertical furnace which is filled with a carbonaceous solid reducing agent and provided with a plurality of tuyeres at an upper stage and a lower stage, respectively, at the lower portion thereof, preliminarily reducing powdery iron ore in the fluidizing furnace with the exhausted reducing gas feeding the resulting preliminarily reduced iron ore together with hot air through the tuyeres at the upper stage into the vertical furnace, and feeding powdery boron oxide or boric acid in a weight ratio of boron oxide to iron oxide being 0.05–0.8 together with hot air through the tuyeres of the lower stage into the vertical furnace to subject the preliminarily reduced iron oxide ore and boron oxide or boric acid to reduction reaction.

2. The method as claimd in claim 1, wherein hot air is blown into the furnace through addtional plurality of tuyeres provided at the stage which is lower than the stage of the tuyeres for feeding boron oxide or boric acid in the vertical furnace.

3. A method for producing ferro-boron which comprises feeding iron oxide and coke into a blast furnace provided with a plurality of tuyeres at the lower portion thereof, and feeding powdery boron oxide or boric acid in a weight ratio of boric acid to iron oxide being 0.05–0.8 into said furnace through the tuyeres to melt and reduce boron oxide or boric acid.

4. The method as claimed in claim 3, wherein hot air is blown into the blast furnace through additional plurality of tuyeres provided at the stage which is lower than the stage of the tuyeres for feeding boron oxide or boric acid in the blast furnace.

* * * * *